United States Patent [19]

Cullen

[11] Patent Number: 4,974,161

[45] Date of Patent: Nov. 27, 1990

[54] HAND-HELD BOWLING DATA PROCESSOR

[76] Inventor: James P. Cullen, 109 Thicket Rd., Baltimore, Md. 21212

[21] Appl. No.: 79,064

[22] Filed: Jul. 29, 1987

[51] Int. Cl.[5] ..... C06F 15/44

[52] U.S. Cl. ..... 364/411; 273/1 ES

[58] Field of Search ..... 364/410–411; 273/37, 1 ES

[56] References Cited

U.S. PATENT DOCUMENTS

| | | | |
|---|---|---|---|
| Re. 28,503 | 8/1975 | Townsend et al. . | |
| 3,375,352 | 3/1968 | House et al. . | |
| 3,738,652 | 6/1973 | Reynolds . | |
| 3,889,253 | 6/1975 | Ross . | |
| 3,907,290 | 9/1975 | Fischer et al. . | |
| 3,974,483 | 8/1976 | Brunson . | |
| 4,092,727 | 5/1978 | Warner . | |
| 4,140,404 | 2/1979 | Kaenel . | |
| 4,225,924 | 9/1980 | Trujillo | 364/411 |
| 4,286,323 | 8/1981 | Meday . | |
| 4,302,010 | 11/1981 | Kaenel | 364/411 |
| 4,824,109 | 4/1989 | Cervantes | 364/411 |

OTHER PUBLICATIONS

"Bowling League Secretary", Instant Software, Inc., Abstract from Microsearch File of Orbit, AN: 84–016795.

"Bowler's Database", Dynacomp, Inc. Abstract from Microsearch File of Orbit, AN: 84–012037.

"Bowling League Secretarial System", Briley Software, Abstract from Microsearch File of Orbit, 83–008416.

"Bowling League Statistics Manager", Ensign Software, Abstract File of Orbit 83–008417.

"League Bowl", Briley Software, Microsearch File of Orbit, AN: 83–006243.

"Bowling Statistician", Microsearch File of Orbit, AN: 83–004079.

*Primary Examiner*—Michael R. Fleming
*Assistant Examiner*—Gail O. Hayes
*Attorney, Agent, or Firm*—Jim Zegeer

[57] ABSTRACT

A portable, hand-held bowling data processor or scoring device which can be kept for up to five persons for various games of bowling. Scores are entered into the device using numeric and function keys, processed by an electronic chip, and displayed in a standard bowling line score format on a display. The device also contains two memories and associated processing logic to provide score analysis for all bowlers during a session of bowling and a more detailed historical analysis for the principal bowler. Provision is also made for an accessory strip printer to create a hard copy of the display.

15 Claims, 6 Drawing Sheets

| 4 | 5 | 6 |
|---|---|---|
| 8 / | 7 | (8) |
| 45 | 62 | 70 |
| +3 | +5 | +1 |

FIG. 4H

| | SCORE | PIN PICKUP | STRIKES | SPARES | SPLITS | CONVERTED SPLITS | OPEN FRAMES |
|---|---|---|---|---|---|---|---|
| AVERAGE | 159 | 85 | 2.3 | 3.6 | .7 | 46% | 3.1 |
| BEST GAME | 230 | 142 | 6 | 2 | 0 | 0 | 2 |

FIG. 4I

HAND-HELD BOWLING DATA PROCESSOR

DESCRIPTION OF THE PRIOR ART

Electronic means of keeping score for the game of bowling are known. Some tenpin bowling establishments are equipped by leading manufacturers with expensive and complex installations which display scores on consoles and overhead cathode ray tube displays (CRTs). Of these, House et. al., U.S. Pat. No. 3,375,352 discloses a bowling scorer untilizing semiconductors that computes scores for a number of games being simultaneously bowled on different lanes. Reynolds, U.S. Pat. No. 3,738,652 discloses a similar bowling score computer in which scores are entered either manually on a keyboard or by remote sensing of the pinfall.

An improved method of displaying scoring data on a CRT is disclosed in Ross, U.S. Pat. No. 3,889,253, as is a similar CRT display in Townsend et. al., U.S. Pat. Reissue No. 28,503. Fischer et. al., U.S. Pat. No. 3,907,290 discloses a scoring system designed for a multiplicity of lanes in bowling establishments. The system disclosed in Brunson, U.S. Pat. No. 3,974,483 utilizes time-shareable circuitry for score computation. The bowling scorer disclosed in Warner, U.S. Pat. No. 4,092,727 is another large, console-oriented system displaying team as well as individual player scores. A printer for such scoring systems untilizing dot matrix format is disclosed in Kaenel, U.S. Pat. No. 4,140,404. Trujillo, U.S. Pat. No. 4,225,924 discloses another such system with manual entry of scores and multiple overhead and console CRT displays for adjacent lanes. Finally, Kaenel, U.S. Pat. No. 4,302,010 discloses a means of linking the various scoring processors in a bowling establishment with a central manager's console.

All of these devices take the form of installations designed to be installed in bowling establishments where they keep and display scores for many games taking place simultaneously on numerous lanes. Because of their very intricacy and cost they are in no way adaptable to personal use. Furthermore, such installations are typically found only in tenpin establishments and not readily available for bowlers of duckpins.

In addition, hand-held electronic scoring devices are known. For example, Meday, U.S. Pat. No. 4,286,323 discloses such a device particularly adapted to the game of bridge, utilizing dual displays, one for each opposing side. However, this device would not be suitable for the game of bowling. In bowling, as opposed to bridge, there can be numerous "sides" or, indeed, only one player. Thus a single, customized score display rather than dual, all-purpose displays, are necessary. Nor does the Meday device, as disclosed, have the separate random access memories (RAMs) needed to provide the desirable analyses of bowling scores or easily selectable scoring protocols for both tenpins and duckpins, the two major variations of the sport.

It is an object of this invention to provide a portable, hand-held bowling data processor. Another object of the invention is to provide a hand-held bowling scorekeeping device for providing game analysis for a bowler over a predetermined bowling period such as a session or a year. According to the invention, a hand-held bowling scorekeeping data processor comprises a thin, flat display in the format of a bowling line score as well as other formats suitable for presentation of analyses of such scores.

A microprocessor is provided programmed to: follow the established scoring protocols for the bowling games of tenpins and duckpins; initiate a sequence of queries or prompts to the user upon being energized, including to enter the type of bowling game to be scored (tenpins or duckpins) and the number of bowlers; maintain a frame-by-frame score for up to five bowlers; automatically at the conclusion of score entry for each bowler for a given frame retrieve and display the next bowler's current frame to allow score entry; display the difference, expressed as a positive or negative number, between the score for each frame in the current game and that of the previous game for each bowler; and, provide a detailed game analysis for one of the up to five bowlers.

A keyboard is provided having a plurality of keys including: a numeric section for entering the numerals 0–9; keys to select the type of game (tenpins or duckpins) in conjunction with said sequence of queries; a key for indentifying, in conjunction with one of said numeric keys, a specific bowler; keys to indicate that a strike, spare, or split was made by a bowler; a set of keys for clearing erroneously entered bowling data and entering accurately entered bowling data into said microprocessor; a set of keys for entering bowling data into and retrieving it from the following memory means.

A short-term memory means is provided for storing frame-by-frame score comparisons with the previous game for all said up to five bowlers and supplying same to the microprocessor for selective displaying on the display means. A long-term memory is provided for storing said detailed game analysis for one of the bowlers for selective presentation on the display. An optional printer capable of producing a paper copy of what is displayed on said display.

The device is uniquely designed to conform with the score-keeping protocols of the game of bowling with separate instructional programs for the variations of tenpins and duckpins. It can be used by an individual to keep his or her personal score or by up to five persons. In addition to recording, displaying, and reviewing raw scores the device is capable of performing two levels of analysis of those scores. For all bowlers using the device during a single session of bowling the frame analysis function indicates the trend of the scores for each frame as compared with the last game played. For the principal bowler, i.e. the owner of the device, the game analysis function provides detailed breakdowns of all of that bowler's scores retained in the device's memory, such as strikes, spares, converted splits, etc. The device will also recall from memory and display the detailed line score of the best, or highest-scoring, game of the principal bowler. A plug-in printer will allow permanent records to be generated.

DESCRIPTION OF THE DRAWINGS

FIGS. 4A–4I are examples of displays generated by the device during the bowling of a game.

DETAILED DESCRIPTION OF THE INVENTION

Figure 1:
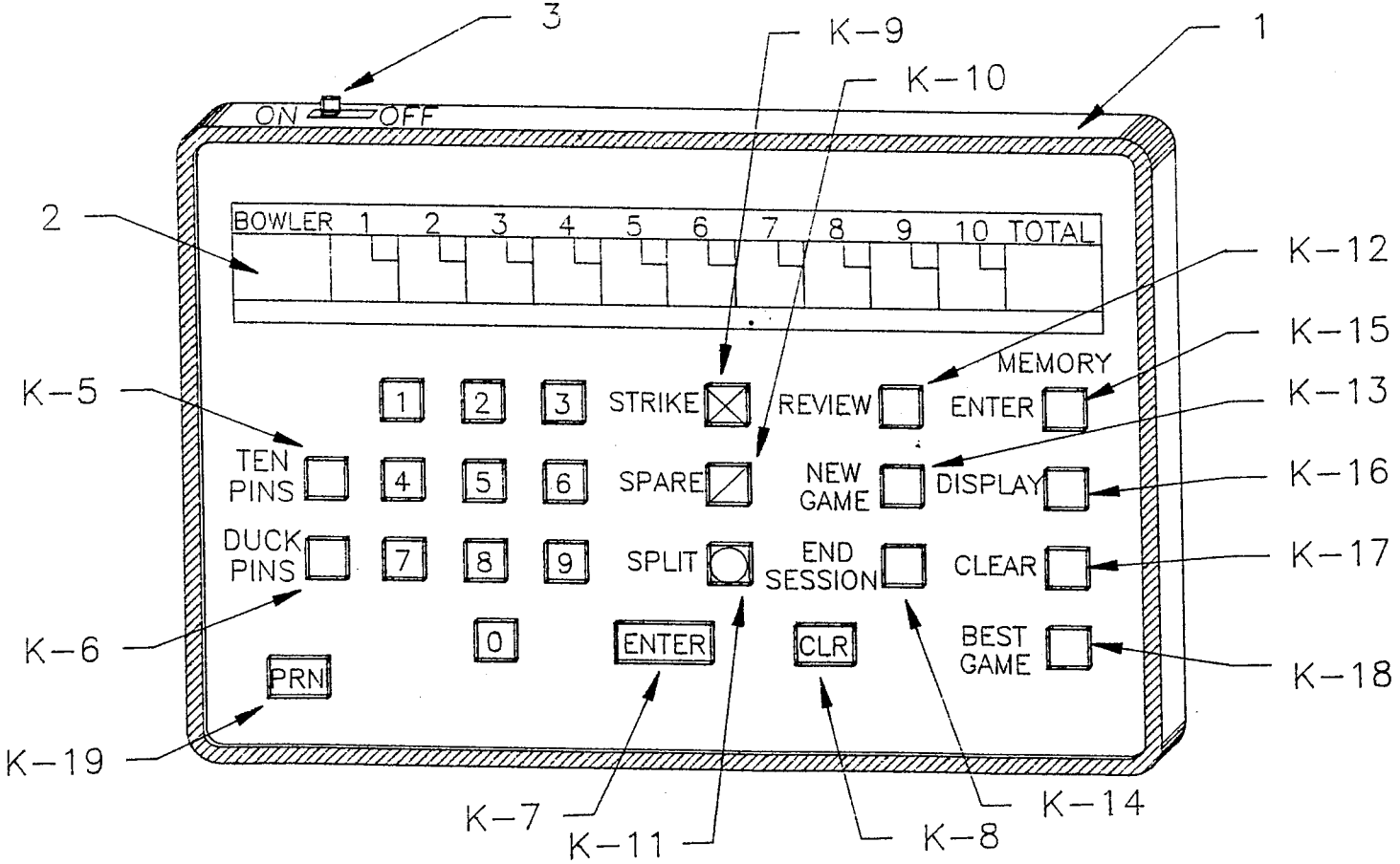
FIG. 1 is an external view of the device.

The external view of the device is shown in FIG. 1 and it includes a case 1, a Liquid Crystal Display (LCD) 2, an On-Off slide switch 3, a numeric key pad K-4

Figure 2:
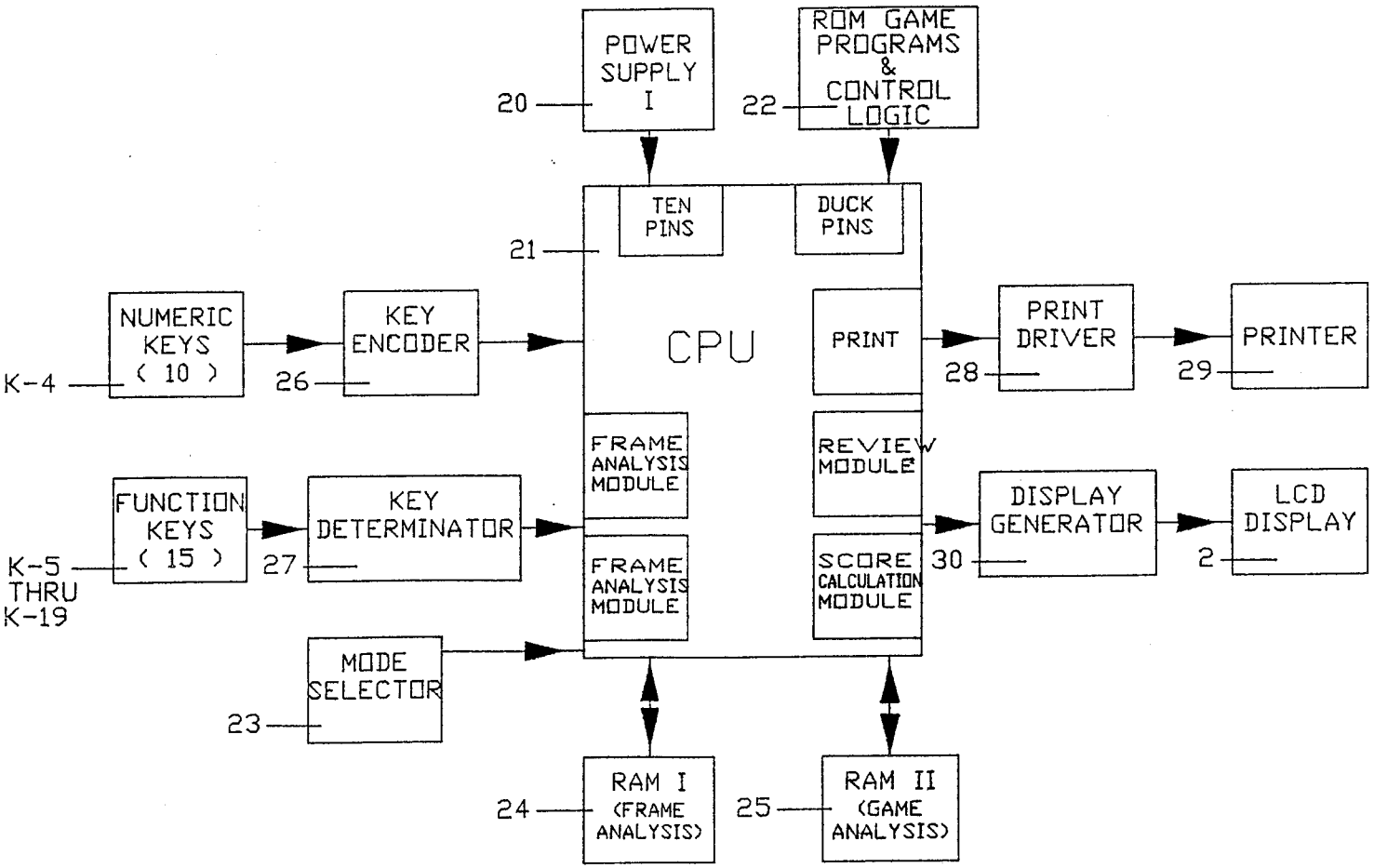
FIG. 2 is a block diagram of the circuitry for the device.

(0–9), and various function keys labeled K-5–K-19. FIG. 2 shows the circuit elements of the device which include: a battery power supply 20, a central processing unit (CPU) 21, a read-only memory (ROM) containing a processing program and control logic 22, a processing mode selector 23, a RAM I for frame analysis 24, a non-volatile RAM II for game analysis 25, numeric keys K-5–K-19 and associated key determinator 27, print driver 28, printer 29, display generator 30, and LCD display 2.

A. Data Entry and Scoring

In operation of the device, the On-Off slide switch 3 is pushed to On activating the power supply 20 and causing the CPU 21 to import the game programs and control logic from the ROM 22. A prompt then appears on the display 2 asking whether score is to be kept for tenpins or duckpins. The appropriate game key K-5 or K-6 is then depressed and the mode selector 23 selects the appropriate scoring protocols from the game programs. Once a game is chosen the device will remain in that mode until a change is entered. Next a prompt will be displayed asking for the number of bowlers, between one and five, to be entered. The corresponding numeric key K-4 is depressed followed by the enter function key K-7 and the number of bowlers selection 31 is made. The display 2 will then show a blank bowling line score as in FIG. 1 ready to receive data entries for bowler #1.

Figure 4A:
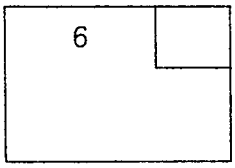
Figure 4D:
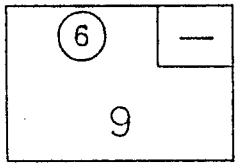
Figure 4B:
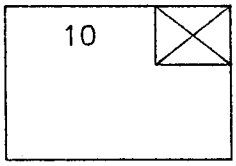
Figure 4E:
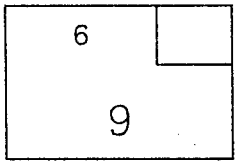
Figure 4C:
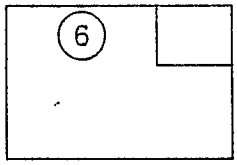

Entry of scoring data is as follows and assumes operation in tenpin mode; that is, two balls per frame. After bowler #1 has rolled the first ball, the number of pins knocked down is entered using the appropriate numeric key K-4 (0–9) and the enter function key K-7. The count will be displayed in the upper left corner of the frame as shown in FIG. 4A. If the wrong value is keyed in at this or any other point in data entry it can be corrected by depressing the clear entry function key K-8 and repeating the entry process. If the first ball results in a strike, or all ten pins being knocked down, the strike function key K-9 is depressed causing a strike symbol to be displayed in the mark box of the frame as shown in FIG. 4B. If the first ball results in a split; i.e., one of several configurations of pins left standing that is especially difficult to convert into a spare, the split function key K-11 is depressed after entering the ball count. This results in a circle surrounding the first ball count displayed in the frame—standard bowling score notation for a split—as shown in FIG. 4C. If the split is not converted into a spare on the second ball a dash will be displayed in the mark box at the completion of the frame as shown in FIG. 4D. Designation of splits will also be used by the game analysis module or function 35 as described below.

Figure 4F:
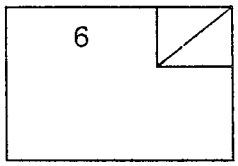

After the second ball is bowled by bowler #1 the resulting additional pin count is entered using the appropriate numeric key K-4 (0–9) and the enter function key K-7. The score calculation module or function 32 will add this count to that of the first ball bowled and display the total for frame #1 as shown in FIG. 4E. If the second ball results in a spare, or all the remaining pins being knocked down, the spare function key K-10 is depressed causing a spare symbol to be displayed in the mark box of the frame as shown in FIG. 4F.

Figure 4G:
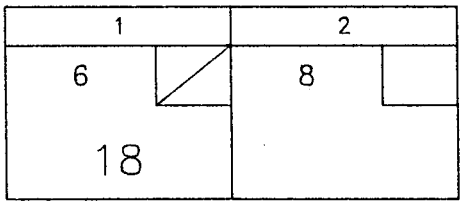

Entry of either a spare or a strike will cause the score calculation module or function 32 to postpone final scoring of a given frame until the results of the next frame for that bowler have been entered. That is, the score for a given frame with a strike is ten plus the number of pins knocked down with the next two balls in a subsequent frame or frames while that for a spare is ten plus the count from the next ball. Thus in the case of the spare in frame #1 shown in FIG. 4F, if the first ball for bowler #1 in frame #2 knocks down eight pins the final score for frame #1 becomes eighteen and will be displayed as such after entry of the first ball pin count for frame #2 as shown in FIG. 4G.

When the scoring of frame #1 for bowler #1 has been completed the score calculation module or function 32 enters the results into RAM I 24 and cycles the display 2 to frame #1 for bowler #2. The scoring sequence is then repeated for the number of bowlers previously designated. When the scores of all bowlers for frame #1 have been entered and processed the display 2 returns to frame #2 for bowler #1 and the sequence is repeated until all bowlers have completed a game, which is ten frames plus any additional balls resulting from marks in the tenth frame. Scoring is similar in duckpin mode except that three balls are bowled per frame and appropriate calculations are made by the duckpin game program.

When a game has been completed by all bowlers, bowler #1 has the option of adding its scoring details to RAM II 25 by depressing the enter memory function key K-15. Then the new game function key K-13 is depressed clearing the display 2 and initializing the score calculation module or function 32 to receive input for the next game. When all games of the current session of play have been completed the end session function key K-14 is depressed clearing the display and the data stored in RAM I 24. The device may then be turned off by pushing the On-Off slide switch 3 to off.

Figure 3A:
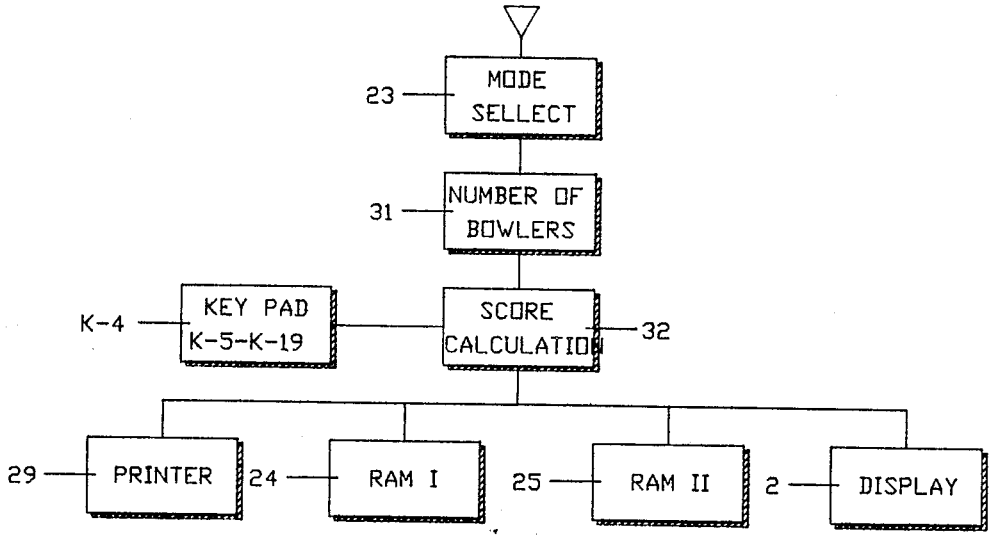
FIGS. 3A–3E are block diagrams of the logic functions of the device.

As is shown in FIG. 3A, the output from the score calculation module or function 32 is used in a number of ways. It updates the display 2 through the display generator 30 to provide continuous readout of the line scores during play. At the same time it places data into RAM I 24 and RAM II 25 to be used in the two score analysis functions described below.

B. Review

Figure 3B:
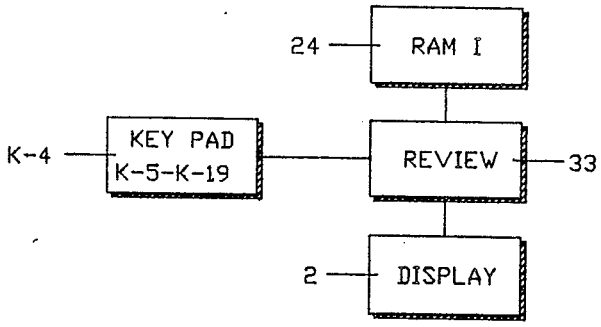

At any time during the scoring of a game and when a game has been completed prior to starting a new game, the line scores of the various bowlers participating can be looked at by using the review module or function 33. As is shown in FIG. 3B this function extracts the requested scoring data from RAM I 24, processes it, and causes it to appear on the display 2. This is accomplished by depressing the review function key K-12 followed by the numeric key K-4 (0–9) corresponding to the number assigned to the bowler whose score is to be displayed thus identifying a specific bowler.

C. Frame Analysis

Figure 3C:
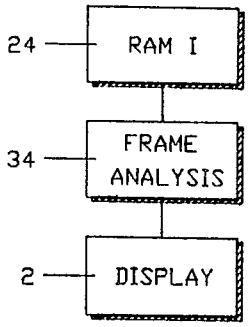

For each bowler, the invention automatically compares the score achieved in each frame of a game with the score for that frame in the previous game and shows the difference as either a positive or negative number at the bottom of the frame in the display. As shown in FIG. 3C, the frame analysis module or function 34 extracts the data regarding each bowler's games of the session that is stored in RAM I 24 processes it, and causes it to appear on the display 2 with the rest of the line score as shown in FIG. 4H. This is accomplished automatically by the frame analysis module or function 34 and does not requre any separate instruction to be entered.

D. Game Analysis

Figure 3D:
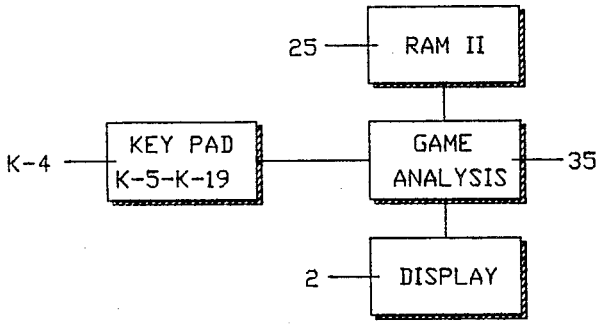

This function of the invention is available for bowler #1 or the principal bowler. It provides detailed analysis of bowler #1's scores which have been accumulated in a separate, non-volatile memory which retains this data between bowling sessions when the device has been turned off. As shown in FIG. 3D, the game analysis module or function 35 extracts this data from the non-volatile memory, RAM II 25, processes it, and causes it to appear on the display 2. This function can be accessed at any time either during the scoring of a game or games or on a separate occasion and consists of two features.

The first is the display of best game. Depressing the best game function key K-18 causes a full line score of the best, or highest-scoring, game previously entered into RAM II 25 for bowler #1 to be shown on the display 2.

The second is a detailed analysis of all games for bowler #1 in that memory. This feature is accessed by depressing the display memory function key K-16 and causes the analysis as shown in FIG. 4I to be displayed. This display shows a running average of bowler #1's games both in raw score and in six categories of data. These are: strikes; spares; splits; converted splits, i.e. those splits converted into spares on a second ball; open frames, i.e. those in which no mark was made; and pin pickup, i.e. the total number of pins in a game that were added as a result of strikes and spares. The average values are shown in each category and are also compared with those of the best game. RAM II 25 can be erased by depressing the clear memory function key K-17 which results in a "Clear Memory?" prompt on the display 2. Depressing the key a second time erases the memory.

E. Printing

Figure 3E:
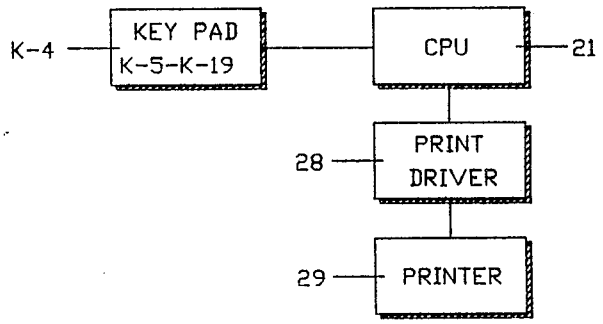

The invention includes an optional strip printer which is capable of generating a hard copy of whatever appears on the display 2. As is shown in FIG. 3E, data from the CPU 21 is imported by the print driver 28, formatted, and sent to the printer 29. This feature is accomplished by depressing the print function key K-19.

It should now be apparent to those skilled in the art that a hand-held electronic bowling data processor has been provided. While I have shown and described a preferred embodiment of my invention, it will be apparent to those skilled in the art that various modifications and adaptations of the invention will be readily apparent and it is intended to encompass within the spirit and scope of the following Claims such modifications and adaptations as would be obvious to one skilled in the art.

What is claimed is:

1. A hand-held bowling scorekeeping data processor comprising a thin, single flat display means in the format of a bowling line score as well as other formats suitable for presentation of analyses of bowling scores, and the means for driving said display, said means for driving said display including:

(1) a microprocessor programmed to:

(a) selectively follow the established scoring protocols for the bowling games of tenpins and duckpins;

(b) upon being energized, initiate a sequence of queries (prompts) to the user including means to select the type of bowling game to be scored (tenpins or duckpins) and the number of bowlers whose scores are to be recorded;

(c) maintain a frame-by-frame score for up to five bowlers;

(d) automatically at the conclusion of score entry for each bowler for a given frame retrieve and display the next bowler's current frame to allow score entry;

(e) display the difference, expressed as a positive or negative number, between the score for each frame in the current game and that of the previous game for each bowler; and (f) provide a detailed game analysis for a plurality of previously bowled games for a selected one of the said up to five bowlers;

(2) a keyboard having a plurality of keys including:

(a) a numeric section for entering the numerals 0–9;

(b) keys to select the type of game (tenpins or duckpins) in conjunction with said sequence of queries;

(c) a key for identifying, in conjunction with one of said numeric keys, a specific bowler;

(d) keys to indicate that a strike, spare, or split was made by a bowler;

(e) a set of keys for clearing erroneously entered bowling data and entering accurately entered bowling data into said microprocessor;

(f) a set of keys for entering bowling data into and retrieving it from said microprocessor;

(3) a short-term random access memory means for storing frame-by-frame score comparisons with the immediately preceeding game for all said up to five bowlers and supplying same to said microprocessor for selective displaying on said display means; and (4) a long-term non-volatile random access memory means for storing said detailed analysis of a plurality of games for one of said bowlers for selective presentation on said display means.

2. The hand-held bowling scorekeeping data processor defined in claim 1 including means for producing a hard copy of the bowling data which is displayed on said display means.

3. The hand-held bowling scorekeeping data processor defined in claim 1 including printing means for selectively printing the bowling data stored in said short-term memory means and said long-term memory means.

4. The hand-held bowling scorekeeping data processor defined in claim 1 wherein selected ones of said keys indicate a strike, spare, and split have an "X", "/", and "O" indicia thereon, respectively.

5. A hand-held bowling scorekeeping data processor comprising:

a single thin flat display means and means for driving said thin, flat display means, said means for driving said thin, flat display means including:

a microprocessor programmed to:

(a) selectively follow the established scoring protocols for a selected bowling game, (b) upon energization, initiate a sequence of quries or prompts to the user including the number of bowlers, (c) maintain frame-by-frame score for said bowlers, (d) automatically at the conclusion of score entry for each bowler for a given frame retrieve and display the next bowler's current frame to allow score entry, (e) provide a detailed game analysis for a plurality of previously bowled games for a predetermined bowler, a bowling data entry board having a plurality of data entry means including:

(a) a numeric section for entering the numerals 0–9, (b) means for identifying, in conjunction with one of said numeric keys, a specific bowler, (c) means for indicating whether a strike, spare, or split is made by a bowler, (d) means for clearing erroneously entered bowling data, and first random access memory means for storing frame-by-frame scores for all bowlers and supplying said frame-by-frame scores to said microprocessor for selectively displaying on said display means, and a non-volatile long-term random access memory means for storing said detailed analysis for a plurality of previously bowled games for said predetermined bowler for selective presentation on said display means.

6. The hand-held bowling scorekeeping data processor defined in claim 5 wherein said microprocessor is programmed to provide a detailed game analysis for a selected one of said bowlers and, wherein said memory means includes a short-term memory for storing frame-by-frame score comparisons for all said, and a long-term memory for storing a said detailed game analysis for one of said bowlers.

7. The hand-held bowling scorekeeping data processor defined in claims 5 or 6, wherein said memory means stores frame-by-frame score comparisons with the previous game for all bowlers and supplying said score comparisons to said microprocessor for selectively displaying on said display means.

8. A hand-held bowling scorekeeping data processor comprising, in combination: a thin flat display means and means for driving said thin, flat display means, said means for driving said thin flat display means including:

a microprocessor programmed to maintain frame-by-frame score for up to five bowlers and, at the conclusion of the score entry for each bowler for a given frame retrieve and display the next bowler's current frame to allow score entry for said next bowler, and provide a detailed game analysis for a plurality of previously bowled games for a selected one of said up to five bowlers, a bowling data entry board having a plurality of data entry means including:

(a) a numeric section for entering the numerals 0–9, (b) a type select means for selecting the game type and condition thereby causing said microprocessor for scoring according to the game type selected, (c) means for identifying, in conjunction with one of said numeric data entry sections, a specific bowler, (d) means for indicating whether a strike, spare or split is made by a bowler, (e) means for clearing erroneously entered bowling data, a short-term random access memory means for storing frame-by-frame score comparisons with the previous game for all of said up to five bowlers and supplying said comparisons to said microprocessor for selectively displaying on said display means and, a long-term non-volatile random access memory means for storing said detailed game analysis for a plurality of games for one of said bowlers for selective presentation on said display means, and wherein said short-term memory means is adapted to store frame-by-frame score comparisons for all of said up to five bowlers, and said long-term memory stores said detailed game analysis for said plurality of previously bowled games for said selected one of said up to five bowlers.

9. A portable hand-held personal bowling score keeping device comprising:

a case, a single display means mounted in said case, a keyboard having a plurality of keys, including a set for entering the numerals 0–9, a key for identifying, in conjunction with one of said numeric keys, a specific bowler, a set of keys framing whether a strike, spare or split is made by a bowler, a set of keys for clearing erroneously entered bowling score data and entering accurately entered bowling data, a microprocessor programmed to:

(a) follow a predetermined scoring protocol for a selected bowling game, (b) initiate a sequence of queries or prompts to the user upon energizing same, including the number of bowlers entered on said keyboard, (c) maintain frame-by-frame score for up to five bowlers, (d) automatically at the conclusion of score entries for each bowler for a given frame retrieve and display on said display means the next bowler's current frame to allow score entry of said next bowler, and first memory means for storing frame-by-frame score comparisons with the previous game for all said up to five bowlers and supplying score comparisons to said microprocessor for selectively displaying on said display means, means for causing said microprocessor to provide a detailed game analysis for one of said up to five bowlers and a non-volatile random access memory means for storing detailed game analysis for a plurality of games for one of said up to five bowlers for selective display on said display means.

10. The portable hand-held personal bowling score keeping device defined in claim 9 including, a print driving means, and means for coupling a printing device to said print driving means for producing a hard copy of bowling data stored in said memory means.

11. A portable, hand-held personal use bowling score keeping device comprising in combination, a hand-held case, a single display means mounted in said case, a keyboard having a plurality of keys, including a set for entering the numerals 0–9, means for identifying a specific bowler, a set of keys framing whether a strike, spare or split is made by a bowler, a set of keys for clearing erroneously entered bowling score data, a microprocessor programmed to:

(a) follow a predetermined scoring protocol for a selected bowling game, (b) initiate a sequence of prompts to the user upon energizing said microprocessor, including the number of bowlers entered on said keyboard, (c) maintain a frame-by-frame score for up to five bowlers, (d) automatically, at the conclusion of score entries for each bowler for a given frame, retrieve and display the next bowler's current frame to allow score entry of said next bowler, random access memory means for storing a plurality of scores for said at least one of five bowlers and frame-by-frame score comparisons with the previous game for all said up to five bowlers and supplying said comparison to said microprocessor for selective display on said display means, and means for causing said microprocessor to derive a detailed bowling score analysis for a plurality of games stored in said random access memory for at least one of said up to five bowlers bowling score and displaying said bowling score analysis on said display means.

12. The portable, hand-held personal use bowling score keeping device defined in claim 11 wherein said means for deriving a detailed bowling score analysis for said plurality of games includes displaying a running average for said plurality of games of said at least one of said up to five bowlers games both in scores and data selected from the following categories:

strikes,
spares,
splits,
converted splits,
open frames, and
pin pick-up.

13. The portable, hand-held personal use bowling score keeping device defined in claim 11 wherein said memory includes a separate, non-volatile random access memory for storing said plurality of scores of said one of up to five bowlers.

14. A hand-held bowling score keeping device comprising in combination, a hand-held case having a surface, a single liquid crystal display means (LCD) in the format of a bowling line score with individual frames for the display of a bowler's score, said display means being mounted in said case on said surface, a keyboard having a plurality of keys, said keys including a set for entering the numerals 0–9, means for identifying a specific bowler, a set of keys whether a strike, spare or split is made by a bowler, a set of keys for clearing erroneously entered bowling score data, a microprocessor mounted in said case and programmed to:

(a) follow a predetermined scoring protocol for a selected bowling game, (b) initiate a sequence of prompts to the user upon energizing of said microprocessor, including the number of bowlers entered on said keyboard, (c) maintain a frame-by-frame score for up to five bowlers and provide a frame-by-frame comparison with a previous game for all of said bowlers, (d) automatically, at the conclusion of score entries for each bowler for a given frame, retrieve and display the next bowler's current frame on said LCD display and to allow score entry of said next bowler, random access memory means in said case and connected to said microprocessor for storing said frame-by-frame scores and comparisons for all to said up to five bowlers and supplying said frame-by-frame scores to said microprocessor for selectively displaying on said LCD display means.

15. The hand-held bowling score keeping device defined in claim 14 including frame analysis means for automatically comparing the score achieved in each frame of a game with the score for that frame in at least one previous game and display the difference on said LCD means as either a positive or negative number at the bottom of said each individual frame in said LCD means.

* * * * *